US007340910B2

(12) United States Patent
Thompson

(10) Patent No.: US 7,340,910 B2
(45) Date of Patent: Mar. 11, 2008

(54) SYSTEM AND METHOD OF INCREASING EFFICIENCY OF HEAT PUMPS

(76) Inventor: Thomas W. Thompson, P.O. Box 389, Lonoke, AR (US) 72086

( * ) Notice: Subject to any disclaimer, the term of this patent is extended or adjusted under 35 U.S.C. 154(b) by 617 days.

(21) Appl. No.: 11/019,458

(22) Filed: Dec. 23, 2004

(65) Prior Publication Data

US 2005/0268628 A1 Dec. 8, 2005

Related U.S. Application Data

(60) Provisional application No. 60/575,844, filed on Jun. 2, 2004.

(51) Int. Cl.

| | |
|---|---|
| ***F25D 17/04*** | (2006.01) |
| ***F25B 49/00*** | (2006.01) |
| ***F24F 11/00*** | (2006.01) |
| ***G05D 23/00*** | (2006.01) |

(52) U.S. Cl. ..... 62/186; 236/DIG. 9; 236/44 A; 700/299; 62/176.5

(58) Field of Classification Search ..... 62/186, 62/176.5, 179, 183, 160; 165/247, 244; 236/DIG. 9, 236/44 A; 700/299, 300

See application file for complete search history.

(56) References Cited

U.S. PATENT DOCUMENTS

| | | | | |
|---|---|---|---|---|
| 3,339,628 | A | 9/1967 | Sones et al. | |
| 4,324,288 | A | 4/1982 | Karns | |
| 4,364,237 | A | 12/1982 | Cooper et al. | |
| 4,408,713 | A | 10/1983 | Iijima et al. | |
| 4,627,484 | A | 12/1986 | Harshbarger, Jr. et al. | |
| 4,860,552 | A | 8/1989 | Beckey | |
| 5,202,951 | A | 4/1993 | Doyle | |
| 5,492,273 | A | 2/1996 | Shah | |
| 5,673,568 | A * | 10/1997 | Isshiki | 62/228.4 |
| 6,131,402 | A | 10/2000 | Mills, Jr. et al. | |
| 6,695,046 | B1 * | 2/2004 | Byrnes et al. | 165/247 |

OTHER PUBLICATIONS

ICM326H/ICM327H Line Voltage Head Pressure Control Application Guide, ICM Controls corporation, downloaded from http://www.icmcontrols.com/products/pdf/icm326-ag.pdf on Nov. 12, 2004.

* cited by examiner

*Primary Examiner*—Chen Wen Jiang
(74) *Attorney, Agent, or Firm*—Richard C. Litman

(57) ABSTRACT

The system and method for increasing efficiency of heat pumps employs temperature sensors to measure the indoor refrigerant coil (indoor heat exchanger) and supply duct air temperature in a heat pump system to vary the indoor air flow rate based on the amount of heat being supplied by the heat pump. By monitoring the indoor refrigerant coil temperature, and the supply duct air temperature near the unit, the airflow can be adjusted to match the BTU (heat) output of the heat pump system. Less air flow over a cooler indoor refrigerant coil temperature allows increased, more efficient, heat transfer, allowing the cooler indoor refrigerant coil temperature to more effectively warm the air. Additionally, with airflow reduced when the indoor refrigerant coil is operating at lower than optimal temperatures or during a defrost cycle, the reduced airflow into living spaces presents a less drafty and more comfortable condition.

11 Claims, 3 Drawing Sheets

SYSTEM AND METHOD OF INCREASING EFFICIENCY OF HEAT PUMPS

CROSS-REFERENCE TO RELATED APPLICATION

This application claims the benefit of U.S. Provisional Patent Application Ser. No. 60/575,844, filed Jun. 2, 2004.

BACKGROUND OF THE INVENTION

1. Field of the Invention

The present invention relates to heating systems. More specifically, the invention is a system and method for increasing heating efficiency in heat pumps.

2. Description of the Related Art

Heat pump systems for residential and commercial heating and air conditioning applications are well known among heating, ventilating, and air conditioning (HVAC) systems, and are popular for their relative energy efficiency in a broad range of heating operations.

A heat pump system typically uses an outdoor heat-exchanging coil to extract heat from outdoor air. Refrigerant flowing through the coil is heated, and pumped through an indoor heat-exchanging coil. An air-circulating blower moves indoor air through ductwork and over the indoor heat-exchanging coil, warming the air.

It can be readily recognized that, as outdoor temperatures drop, it becomes increasingly difficult for the heat pump to extract heat from colder outdoor air. As outdoor air becomes colder, the refrigerant temperature delivered to the indoor heat-exchanging coil drops, reducing the amount of heat transferred to the indoor air. Especially after the unit first starts in response to a thermostat command, and before the refrigerant and indoor coil have had a chance to become fully heated, heat pump units often circulate uncomfortably cool air into interior living spaces, when outdoor temperature are low, in a phenomenon known as a "cold blow".

A cold blow may additionally be experienced as a heat pump system undergoes a defrost cycle. During operation, the heat pump's outdoor heat-exchanging coil becomes chilled, colder still than the outside air, as heat is transferred to the refrigerant. Thus, it is common, under certain operating conditions, for frost to form on the outdoor heat-exchanging coil, reducing efficiency and ultimately preventing the heat pump's operation if frost buildup is excessive. Heat pump systems often go into a reverse cycle, functioning for a brief period in an air conditioning mode whereby the outdoor heat-exchanging coil is warmed to eliminate frost. During this reverse cycle, the indoor heat-exchanging coil is cooled, rather than heated, contributing to a cold blow.

Supplemental electric resistance heating elements are often used to heat the indoor air during defrost cycling, and to provide additional heating during periods when low outdoor air temperatures prevent the heat pump warming indoor air to comfortable levels. The use of supplemental electric resistance heating elements, however, increases energy requirements for the system, resulting in a decrease in heating efficiency.

Various systems and methods have been employed to improve efficiency of heat pump operation, and to reduce cold blow effects during defrost cycling and during periods when low outdoor air temperatures hinder operation of the heat pump.

U.S. Pat. No. 6,131,402, issued on Oct. 17, 2000 to E. Mills, Jr. et al., discloses an apparatus and method of operating a heat pump to improve heating supply air temperature. A temperature sensor, placed proximate to the outside coil, which functions as the evaporator during heating operations, monitors the outside ambient air temperature. Blower speed is set according to the outdoor ambient air temperature. A supply air sensor may be included to sense the air flow rate or air temperature at the exit of a condenser duct, providing a closed loop determination of motor speed based on the sensed supply air characteristic and target air flow.

U.S. Pat. No. 5,202,951, issued on Apr. 13, 1993 to E. Doyle, discloses a mass flow rate control system and method for controlling a variable speed motor to drive a blower to maintain a desired air flow under varying resistances of a heating system. The system varies the blower speed to maintain a constant mass flow rate under variations in air flow resistance in the heating system.

U.S. Pat. No. 5,492,273, issued on Feb. 20, 1996 to R. Shah, discloses an HVAC system having a variable speed indoor blower motor. A motor speed controller provides for two, or three, defined airflow rates. Rather than continuously varying the motor speed according to indoor coil temperature and supply duct temperatures to match BTU output to airflow, the controller sets the motor speed for one of the defined air flow rates according to an operational state of the system.

U.S. Pat. No. 4,860,552, issued on Aug. 29, 1989 to T. Beckey, discloses a heat pump fan control that provides a variable time delay between startup of the compressor and startup of the blower fan. The delay time is determined by the outdoor air temperature, and increases as the outdoor temperature decreases.

U.S. Pat. No. 4,627,484, issued on Dec. 9, 1986 to J. Harshbarger, Jr. et al., discloses a heat pump control system that monitors defrost cycling of the heat pump, and shuts down the heat pump if the defrost cycle continues for an excessive length of time or if outside ambient temperature is excessively low. The heat pump is thus disabled when weather conditions do not favor efficient heat pump operation.

U.S. Pat. No. 4,364,237, issued on Dec. 21, 1982 to K. Cooper et al., discloses a heat pump system in which the compressor speed is varied in response to load conditions. The indoor fan speed is varied according to the compressor speed And the outdoor air temperature.

U.S. Pat. No. 4,324,288, issued on Apr. 13, 1982 to P. Karns, discloses a level supply air temperature heat pump system and method. The air temperature of air discharged from the indoor heat exchanger of a heat pump system is measured and used to control the indoor fan speed to maintain the supply air temperature at a relatively constant level.

U.S. Pat. No. 3,339,628, issued on Sep. 5, 1967 to W. Sones et al., discloses an electrically controlled heating system wherein a fan motor is operated at variable speeds. The system uses temperature sensors located variously within the living spaces to vary the fan motor speed during both heating and cooling operations, but does not measure the available heat output during heating operations to set the fan motor speed for optimal heat transfer.

U.S. Pat. No. 4,408,713, issued on Oct. 11, 1983 to T. Iijima et al., discloses a control for automobile air conditioning systems wherein the airflow rate is controlled in relation to a sensed ambient air temperature and the temperature of a heat source for the system. The airflow rate is increased gradually over a time interval after the system is activated. The rate of increase is determined by the temperature of the system heat source, but the airflow rate does not track changes in the temperature of the heat source.

None of the above inventions and patents, taken either singly or in combination, is seen to describe the instant invention as claimed. Thus a method of increasing efficiency of heat pumps solving the aforementioned problems is desired.

SUMMARY OF THE INVENTION

The system and method for increasing heating efficiency in heat pumps employs temperature sensors to measure the indoor refrigerant coil (indoor heat exchanger) and supply duct air temperature in a heat pump system to vary the indoor air flow rate based on the amount of heat being supplied by the heat pump.

By monitoring the indoor refrigerant coil temperature and the supply duct air temperature near the unit, the airflow can be adjusted to match the BTU (heat) output of the heat pump system. Less air flow over a cooler indoor refrigerant coil temperature allows increased, more efficient, heat transfer, allowing the cooler indoor refrigerant coil temperature to more effectively warm the air. Additionally, with the air flow reduced at times when the indoor refrigerant coil is operating at lower than optimal temperatures or during a defrost cycle, the reduced air flow into living spaces presents a less drafty condition, reducing or eliminating unpleasant effects of a cold blow and providing a more consistent comfort level.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
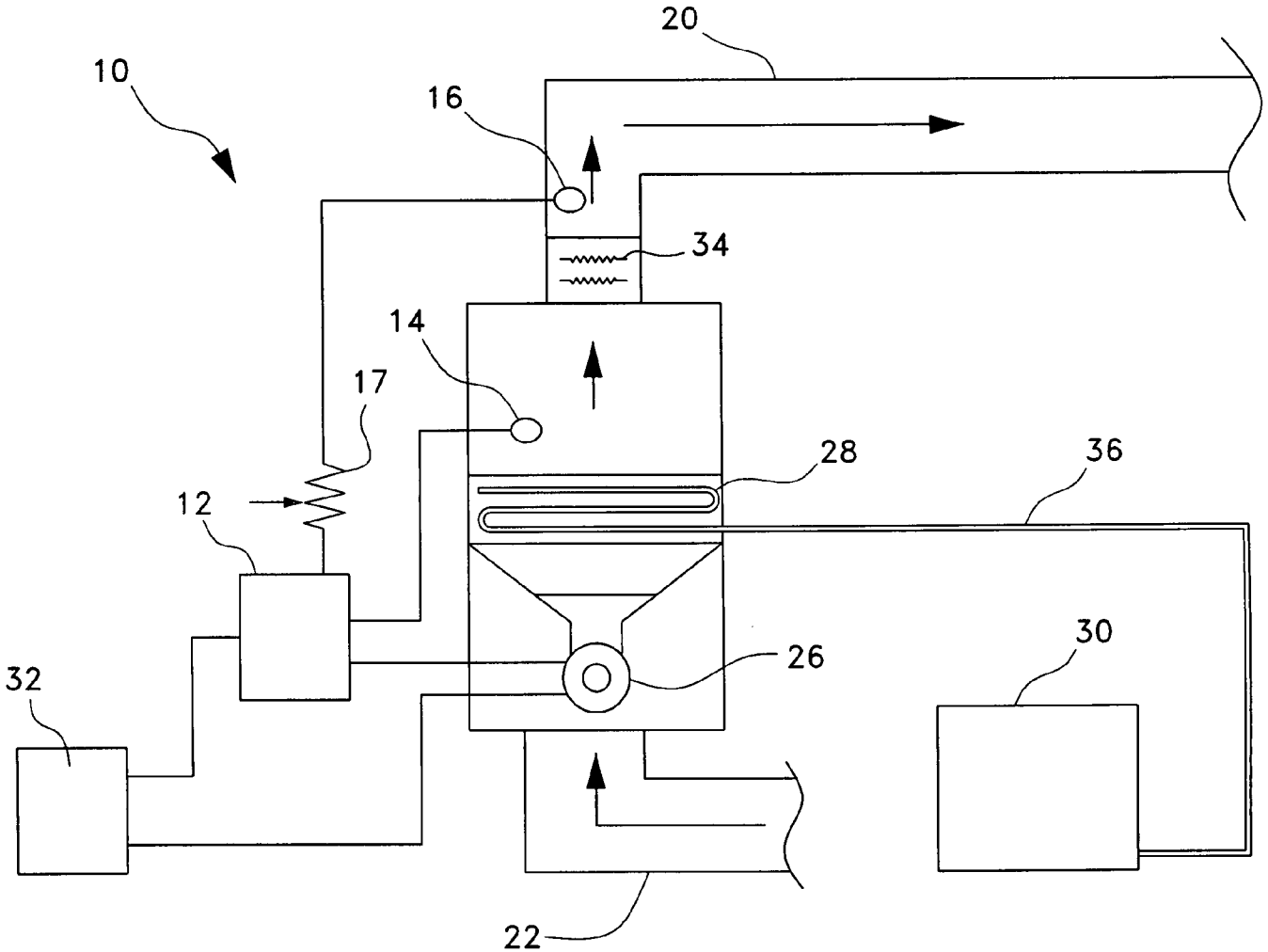
FIG. 1 is a diagrammatic view of a heat pump system employing a system and method for increasing heating efficiency in heat pumps according to the present invention.
Figure 2:
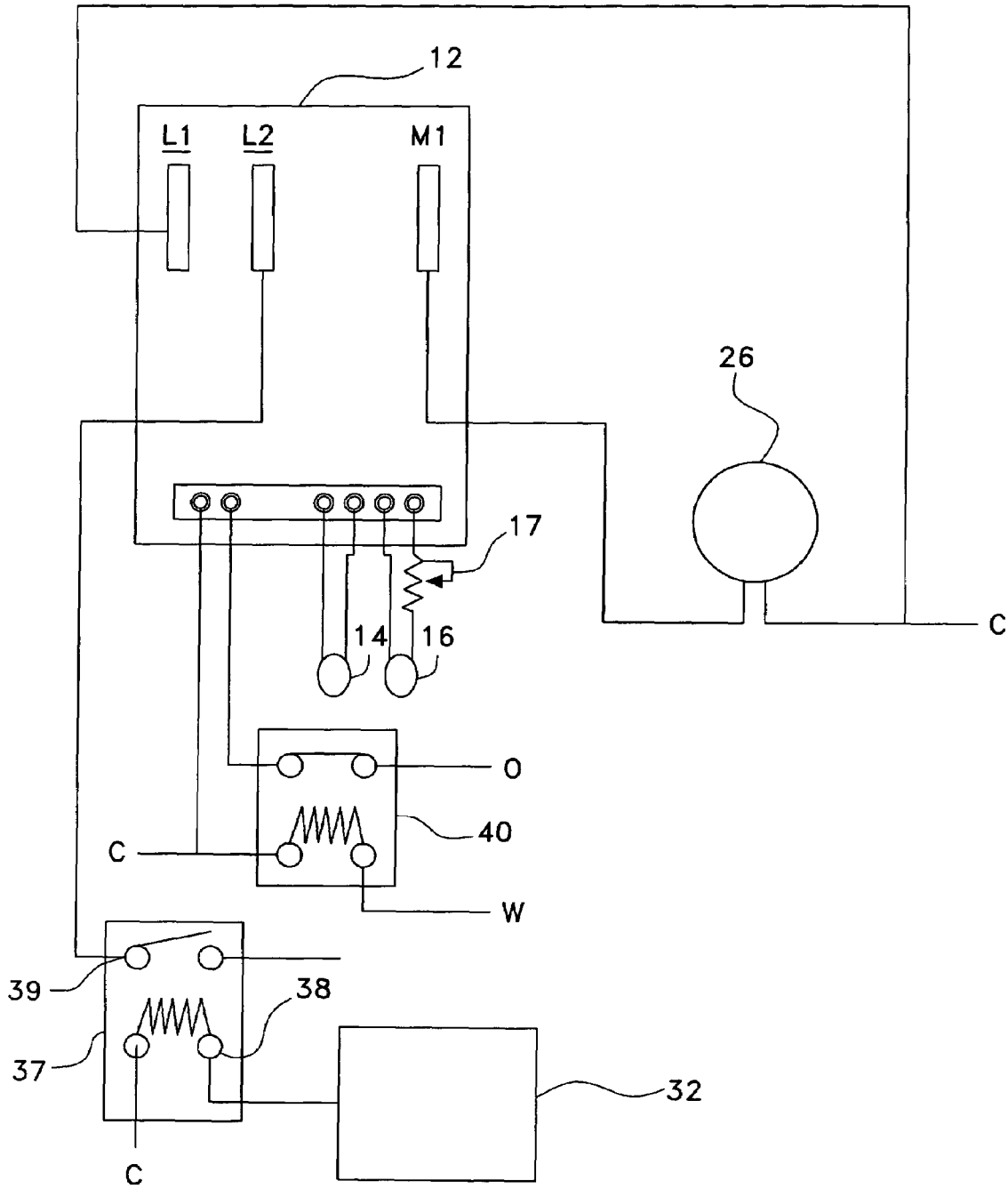
FIG. 2 is a schematic diagram of a system for increasing heating efficiency in heat pumps according to the present invention.
Figure 3:
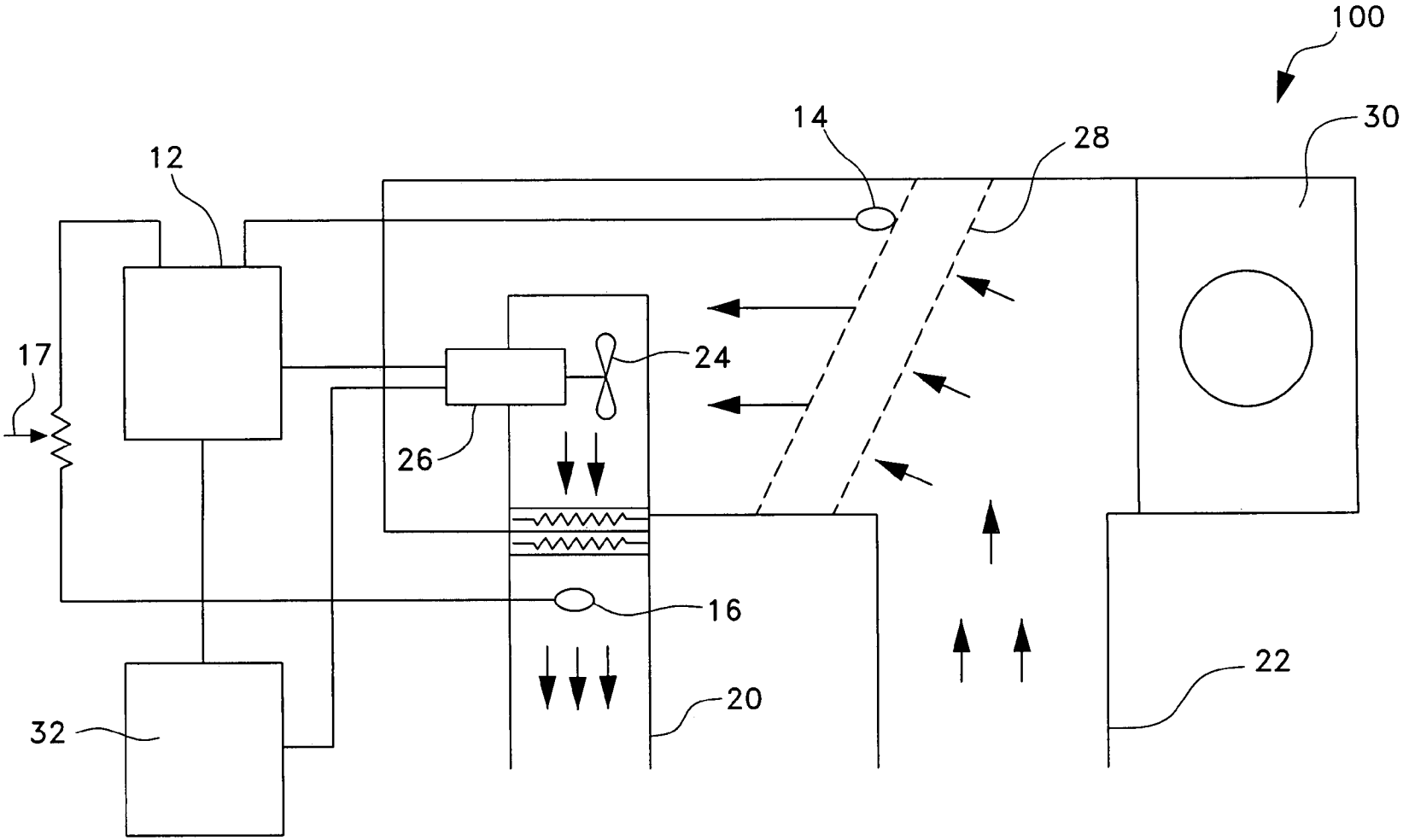
FIG. 3 is a diagrammatic view of a single unit heat pump employing a system and method for increasing heating efficiency in heat pumps according to the present invention.

The present invention is a system and method for increasing efficiency in heat pump systems. Referring to FIGS. 1-3, a heat pump system 10 incorporating a system for increasing efficiency in heat pump systems according to the present invention is shown. The heat pump system 10 has, in a generally known configuration, an outdoor condenser unit 30 connected by refrigerant lines 36 to an indoor heat-exchanging coil 28. The indoor heat-exchanging coil 28 is disposed, along with a blower fan 24 and blower motor 26, within ductwork comprising a return duct 22 and a supply duct 20. Resistive heating elements 34 are disposed downstream of the indoor heat-exchanging coil 28. An indoor thermostat 32 controls the operation of the blower motor 26. Typically, the thermostat 32 operates a motor relay 37 to switch the fan motor 26. As shown in FIG. 2, the thermostat 32 is in communication with a switching input 38 of the motor relay 37. On receiving a signal from the thermostat 32, a switched output 39 of the motor relay 37 switches a control input to the control circuit 12 to operate the blower motor 26.

During heating operations, the outdoor condenser unit 30 heats a refrigerant that is circulated through the refrigerant lines 36 and the indoor heat-exchanging coil 28, thereby heating the indoor heat-exchanging coil 28. The resistive heating elements 34 provide supplemental heating during periods of operation when, due to environmental conditions, the outdoor condenser unit 30 in unable to perform adequate heating.

Referring to FIGS. 1 and 2, the system for increasing efficiency in heat pump systems according to the present invention comprises a control circuit 12, a thermistor 14 disposed on the indoor heat-exchanging coil 28, and a thermistor 16 disposed in the supply duct 20 just downstream from the resistive heating elements 34. Thermistors 14 and 16 are electrically connected to the control circuit 12, whereby the control circuit 12 can monitor the temperature of the indoor heat-exchanging coil 28 and the air entering the supply duct 20. The control circuit 12 is in electrical communication with the thermostat 32 and with the blower motor 26. Electrical common connections are indicated in FIG. 2 at reference number C.

The control circuit 12 measures the temperature of the indoor heat-exchanging coil 28, using thermistor 14, and the temperature of air entering the supply duct 20, using thermistor 16. Using the higher value of thermistor 14 and thermistor 16, the control circuit 12 determines an appropriate speed for the blower motor 26 and powers the blower motor 26 accordingly.

The control circuit 12 decreases the speed of the blower motor 26 when lower temperatures are measured by thermistor 14 and thermistor 16, thereby decreasing the airflow through the ducts across the indoor heat-exchanging coil 28 and the resistive heating elements 34. A variable resistor 17, added in series with the thermistor 16, permits a variable bias to the temperature control of the motor speed, allowing a variable setting to accommodate individual comfort and preference.

Blower motor 26 is preferably a permanent split capacitor type variable speed motor, favored for its common availability, lower cost, and greater efficiency in comparison to other types of variable speed motors. The control circuit 12 decreases the blower motor speed by clipping the alternating current (A/C) wave form of the operating power supplied to the blower motor 26, reducing the RMS voltage level. Table 1 sets forth an exemplary mapping of temperature to RMS voltage to the blower motor 26. It can be understood that these values will vary according to specific motor selection and other system design constraints.

TABLE 1

| Temperature (° F.) | RMS Voltage To Blower (V) |
|---|---|
| 85 | 55 |
| 90 | 71 |
| 95 | 90 |
| 100 | 106 |
| 105 | 125 |
| 110 | 145 |
| 115 | 167 |
| 122 | 190 |
| 126 | 240 |

Table 2 illustrates blower speed in relation to supply duct temperatures measured during experimentation, operating a heat pump with an outdoor temperature of thirty-four degrees. Blower speed is measured by percentage of the blower's maximum design RPM.

TABLE 2

| Supply Duct Temp (° F.) | Percent of Maximum Blower Speed |
|---|---|
| 80 | 26% |
| 90 | 29% |
| 95 | 35% |
| 100 | 40% |
| 105 | 44% |
| 110 | 49% |
| 115 | 51% |

At low blower speeds, below about 40% of maximum RPM, the volume of air blowing into living spaces is nearly Unnoticeable. As the BTU input from the outdoor unit 30 to the indoor heat-exchanging coil 28 increases, increasing the amount of heat transferable from the indoor heat-exchanging coil 28 to the air entering the supply duct 20, the blower speed gradually increases, increasing the volume of air circulated into living spaces. As the temperature reaches a maximum set point, the blower speed is increased to 100% of its maximum design RPM. The control circuit 12 employs a hysteresis interval near the maximum temperature/blower speed point, requiring that the measured temperatures drop several degrees before the blower speed is again reduced.

The heat pump system 10 begins operation when the thermostat 32 calls for heat. A control voltage is sent to the outdoor unit 30, activating the outdoor unit to begin circulating heated refrigerant through refrigerant lines and through the indoor heat-exchanging coil 28. The indoor blower motor 26 is started after a short delay. On startup, the blower motor 26 is first operated at full power for a short interval (of about one second or less) to promote motor bearing lubrication. The control circuit 12 then reduces the blower speed, setting the blower speed according to the measured temperatures.

During defrost operations, when the outdoor unit 30 reverses operations to chill, rather than heat, the refrigerant circulated through the indoor heat-exchanging coil 28 and thereby defrost outdoor coils, resistive heating elements 34 are activated to heat the air circulated through the supply duct 20. During this mode of operation, the air temperature measured by thermistor 16 downstream of the resistive heating elements 34 drives the control circuit 12. The blower motor 26 is controlled to provide a high air temperature to air volume ratio, insuring efficient heating and lack of uncomfortable cold blow effects in the living spaces. A relay 40, in connection with both the control circuit 12 and a defrost control of the outdoor unit, prevent the control circuit 12 from operating the blower motor 26 at full speed when the outdoor unit 30 is in a defrost cycle.

In one embodiment, a commercially available motor speed controller is used for the control circuit 12. A Line Voltage Head Pressure Control, manufactured by ICM Controls corporation and sold as part number ICM326H, is used to control the speed of an outdoor condenser motor in response to the outdoor condenser temperature, to maintain control of a coolant head pressure at the outdoor condenser. In the present invention, the Line Voltage Head Pressure Control is used as described herein to control the speed of the indoor blower motor 24 of the heat pump system 10.

Referring now to FIG. 3, the system for increasing efficiency in heat pump systems according to the present invention is shown configured within a single-unit type of heat pump system 100, wherein the blower fan 24, blower motor 26, indoor heat-exchanging coil 28 and outdoor unit 30 are contained within a single housing, with supply and return ducts 20, 22 configured for air to be circulated through the heat-exchanging coil 28 by the blower 24. Single-unit heat pumps are typically mounted in a through-the-wall or through-the-roof manner.

It is to be understood that the present invention is not limited to the embodiment described above, but encompasses any and all embodiments within the scope of the following claims.

I claim:

1. A control system for increasing efficiency in a heat pump having an outdoor condensing unit supplying a heated refrigerant to an indoor coil disposed proximately to a blower fan driven by a blower motor within a duct system having supply and return ducts, the control system comprising:

a first temperature sensor having a first temperature-indicating signal, the first temperature sensor being disposed on said indoor coil;

a second temperature sensor having a second temperature-indicating signal, the second temperature sensor being disposed in said supply duct; and a control circuit in electrical communication with said first and second temperature sensors, the control circuit having a variable motor speed control output varying according to one of said first and second temperature-indicating signals, the variable motor speed control output adapted for being electrically connected to the blower motor.

2. The control system according to claim 1, further comprising a variable resistor connected to said control circuit in series with said second temperature sensor.

3. The control system according to claim 1, wherein said control circuit further comprises a motor switching input adapted for being electrically connected to the blower motor.

4. The control system according to claim 3, further comprising a thermostat electrically connected to said motor switching input.

5. The control system according to claim 3, further comprising:

a relay having a switched output and a switching input, the switched output being electrically connected to said motor switching input; and a thermostat electrically connected to the switching input of said relay.

6. The control system according to claim 1, wherein said variable motor speed control output is an electrical signal comprising a variable voltage.

7. The control system according to claim 6, wherein said variable voltage level increases as one of said first and second temperature-indicating signals increases, and decreases as one of said first and second temperature-indicating signals decreases.

8. A method for increasing efficiency in a heat pump having an outdoor condensing unit supplying a heated refrigerant to an indoor coil disposed proximally to a motor driven blower fan and within a duct system having supply and return ducts, the method comprising the steps of:

measuring the temperature of said indoor coil;

measuring the air temperature in said supply duct;

using the greater of said indoor coil temperature and said supply duct air temperature to determine a blower speed, the blower speed being proportional to said greater temperature;

determining a voltage level to drive said motor at said blower speed; and applying said voltage level to said motor.

9. The method according to claim 8, wherein a temperature sensor is disposed on said indoor coil to measure the temperature of the indoor coil.

10. The method according to claim 8, wherein a temperature sensor is disposed in said supply duct to measure the air temperature within the supply duct.

11. The method according to claim 10, wherein said temperature sensor is located downstream from said indoor coil.

* * * * *